US007251970B2

(12) United States Patent
Mielonen

(10) Patent No.: US 7,251,970 B2
(45) Date of Patent: Aug. 7, 2007

(54) CYLINDER HOUSING ARRANGEMENT

(75) Inventor: Pekka Mielonen, Reijola (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 10/545,959

(22) PCT Filed: Feb. 24, 2004

(86) PCT No.: PCT/FI2004/000090

§ 371 (c)(1),
(2), (4) Date: Aug. 12, 2005

(87) PCT Pub. No.: WO2004/081323

PCT Pub. Date: Sep. 23, 2004

(65) Prior Publication Data

US 2006/0150695 A1 Jul. 13, 2006

(30) Foreign Application Priority Data

Mar. 11, 2003 (FI) ..... 20030355

(51) Int. Cl.
*E05B 29/04* (2006.01)

(52) U.S. Cl. ..... 70/366; 70/367; 70/371; 70/373; 70/381; 70/424

(58) Field of Classification Search ..... 70/366, 70/452, 451, 466, 417, 455, 423, 424, 427, 70/428, 453, 454, 448, 449, DIG. 43, DIG. 56, 70/367–373, 381, 420, 450
See application file for complete search history.

(56) References Cited

U.S. PATENT DOCUMENTS 1,422,517 A * 7/1922 Augenbraun ..... 70/417
1,422,594 A * 7/1922 Maxwell ..... 70/417
2,061,456 A * 11/1936 Falk ..... 70/369
2,225,703 A 12/1940 Machinist
2,883,849 A * 4/1959 Lorenzo ..... 70/427
2,930,219 A * 3/1960 Fansmith ..... 70/428
3,267,707 A * 8/1966 Adams ..... 70/419
3,343,386 A * 9/1967 Hall ..... 70/423
3,422,643 A * 1/1969 Foote ..... 70/38 B
3,635,057 A * 1/1972 Foote et al. ..... 70/424
3,735,612 A * 5/1973 Popovici ..... 70/38 A
3,821,886 A 7/1974 Ladewig
3,835,675 A * 9/1974 Lippisch ..... 70/38 A
4,107,967 A * 8/1978 Grabb ..... 70/427
4,211,097 A * 7/1980 Martikainen et al. ..... 70/373

(Continued)

FOREIGN PATENT DOCUMENTS

FI 1468/68 10/1969

*Primary Examiner*—Lloyd A. Gall
(74) *Attorney, Agent, or Firm*—Smith-Hill and Bedell

(57) ABSTRACT

A cylinder housing arrangement, where the cylinder housing encloses a lock cylinder or the like, which comprises a number of locking elements to be arranged by a key, preferably tumbler discs to be turned by a key, which discs in their locked position prevent the turning of the lock cylinder relative to the cylinder housing. The cylinder housing comprises a body part and a separate cover part, which is arranged to be installed in the crosswise direction relative to the cylinder housing at the end of the body part on the inserting side of a key, so that it is locked to the body part in the axial direction of the cylinder housing.

10 Claims, 3 Drawing Sheets

Figure 1:
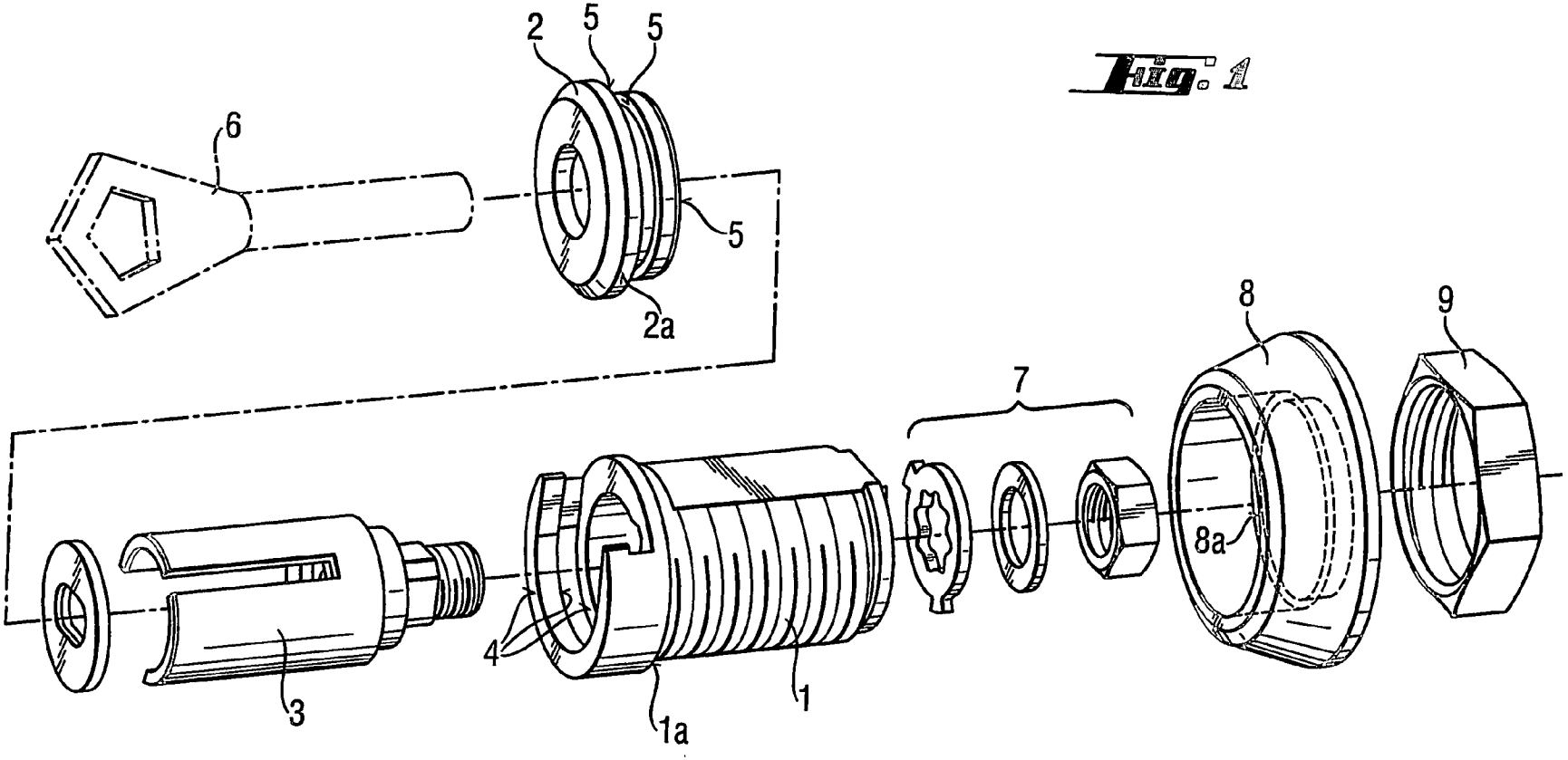

U.S. PATENT DOCUMENTS 4,227,388 A * 10/1980 Nigrelli et al. ..... 70/427
4,290,279 A * 9/1981 Fish et al. ..... 70/38 A
4,679,418 A * 7/1987 Allen ..... 70/380
4,697,444 A * 10/1987 Maffey ..... 70/232
4,712,403 A * 12/1987 Markisello ..... 40/417
4,836,001 A * 6/1989 Foshee ..... 70/368
4,838,055 A 6/1989 Gallagher
4,899,564 A * 2/1990 Gilbert ..... 70/428
4,998,953 A * 3/1991 Wilkin ..... 70/452
5,010,753 A * 4/1991 Boris, Jr. ..... 70/371
5,201,202 A * 4/1993 Kam ..... 70/168
5,279,138 A 1/1994 Gallagher
5,572,890 A * 11/1996 Carpenter ..... 70/371
5,685,184 A * 11/1997 Gallagher ..... 70/358
6,079,240 A * 6/2000 Shvarts ..... 70/367
6,155,090 A * 12/2000 Rubensson ..... 70/367
6,185,966 B1 * 2/2001 Chen ..... 70/366
6,209,365 B1 * 4/2001 Neeley ..... 70/175
6,725,696 B1 * 4/2004 Blight et al. ..... 70/366
6,880,376 B1 * 4/2005 Ko ..... 70/366
7,000,441 B2 * 2/2006 Sutton et al. ..... 70/276

* cited by examiner

CYLINDER HOUSING ARRANGEMENT

The invention relates to a cylinder housing arrangement.

Conventionally a cylinder housing consists of one piece, inside of which a lock cylinder with its locking members are installed from behind, whereby the cylinder housing itself or separate protection elements to be possibly mounted in front thereof form the front surface of the lock. It is possible to install the lock cylinder also from the front of the cylinder housing. As for the strength properties, a front-mounted lock is clearly superior to a conventional lock, if one attempts to break it by striking the lock cylinder inwards. A front-mounted lock is disclosed in the Finnish utility model No. 3629. In this solution the lock cylinder is provided with a separate profiled plate to be mounted at the end thereof forming a part of the front surface of the cylinder housing. The lock cylinder is attached to the cylinder housing by a security plate mounted onto its back end, which plate may be affected by a special key, if the aim is to replace the tumbler disc package of the lock cylinder. The solution is thus complicated and fairly awkward to use.

An object of the present invention is to provide a novel cylinder housing arrangement having a simple structure and being easily assembled and disassembled, which arrangement makes it possible to install the lock cylinder and replace its locking members from the front of the cylinder housing. An aim is also to improve the burglary resistance properties of the lock. A further aim is to provide an arrangement, which is advantageous from the viewpoint of manufacturing technique providing a wide range of options for adapting the cylinder housing to various objects of installation.

According to the invention the cover part is arranged to be installed in the crosswise direction relative to the cylinder housing at the end of the body part on the inserting side of a key, so that it is locked onto the body part in the axial direction of the cylinder housing. This kind of a lock is easy to assemble and disassemble e.g. in order to re-key it. The material of the separate cover part may, if so desired, differ from that of the body part. Naturally also the finishing of the cover part may be different from that of the body part, whereby the cover part may be finished so as to be compatible with the environment. Further, the body part may be for instance unhardened and the cover part case-hardened.

In practice, in order to provide axial locking the body part and the cover part are provided with respective radial counter surfaces, which are arranged to cooperate with one another. The cover part may preferably have a cylindrical shape so that said counter surfaces thereof encircle its periphery. Thus the cover part forms a body of revolution, which may be rotated even when it is already assembled in position, whereby it preferably provides also a drilling shield.

If the front of the cover part is shaped so that it comprises a flange, which is in the radial direction wider than the body part and covers it entirely, the cover part may form the visible front end of the entire cylinder housing after the assembly thereof. Then the material of the installation aperture in the object of installation prevents the removal of the cover part from its position in the radial direction.

The cylinder housing arrangement may preferably also comprise a separate protection fitting element, which is arranged to be installed in the cylinder housing at least for the most part of the position of the cover part. Thus the protection fitting element keeps the cover part in its place. In addition, the protection fitting element may be shaped in different ways so that the assembly of the cylinder housing may be adapted according to the needs and restrictions of the application in question. Further, the protection fitting element may be manufactured by using various kinds of finishes totally independently of the rest of the cylinder housing. The burglary resistance of the lock may preferably be affected by varying the shape, material and material thickness of the protection fitting element, as required.

The body part is preferably provided with a shoulder for the protection fitting element, which shoulder together with a counter surface in the protection fitting element determines the position of the protection fitting element in the axial direction of the cylinder housing. At the same time it prevents the removal of the protection fitting element from the front end of the cylinder housing.

It is advantageous from the viewpoint of manufacturing technique that the body part is at least substantially cylindrical.

Figure 2C:
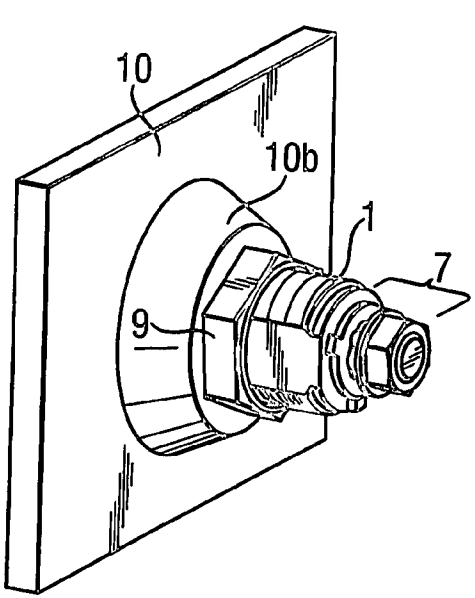
Figure 2B:
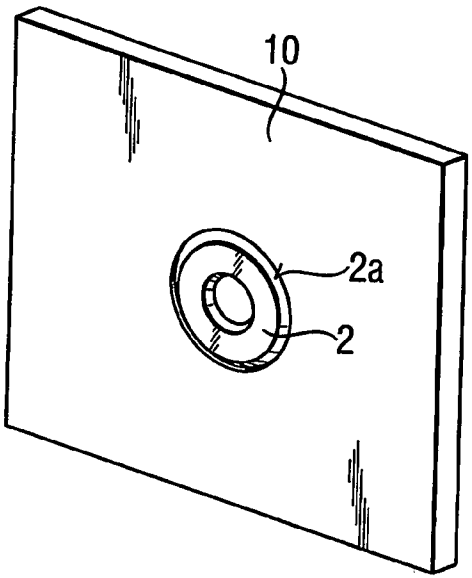
Figure 2A:
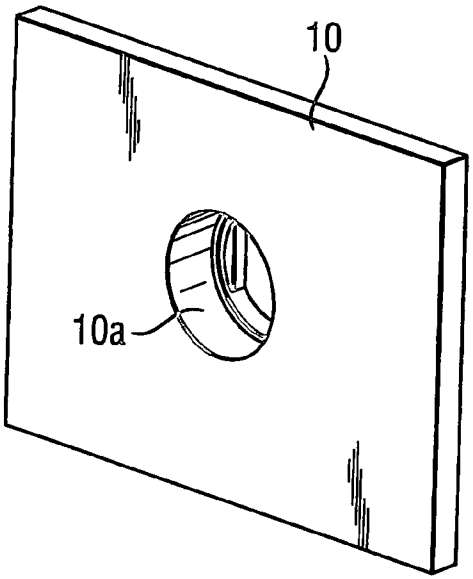
Figure 3B:
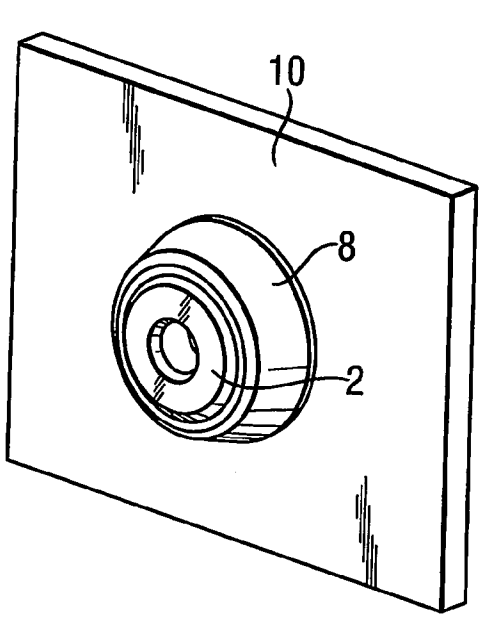
Figure 3A:
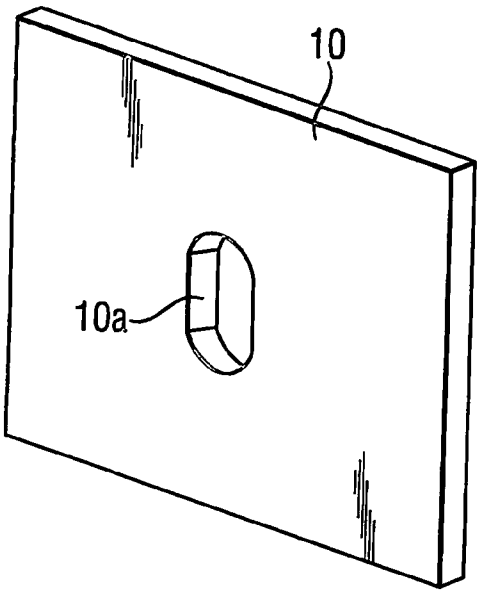
Figure 3C:
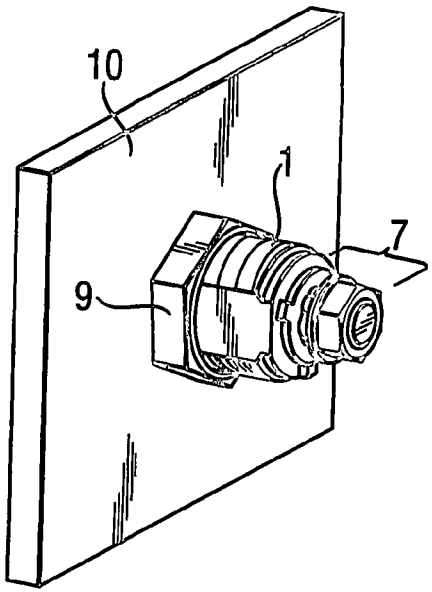

In the following the invention is described by way of example with reference to the attached drawings, in which FIG. 1 is an exploded view of an embodiment of the cylinder housing arrangement according to the invention;

FIGS. 2*a*, 2*b* and 2*c* illustrate an assembly option for the cylinder housing arrangement according to the invention; and FIGS. 3*a*, 3*b* and 3*c* illustrate another assembly option for the cylinder housing arrangement according to the invention.

In the drawings the reference number 1 indicates a body part of a cylinder housing, inside of which a lock cylinder 3 is installed. The lock cylinder conventionally encloses a tumbler disc package and/or other corresponding locking elements, which are not, however, shown in more detail in this context, as they are not as such related to the present invention.

After the lock cylinder 3 together with its locking members is installed inside the body part 1 and attached thereto by means 7, a cover part 2 is installed onto the body part in the radial direction. For this purpose the body part is provided with counter surfaces 4 and the cover part with matching counter surfaces 5, which cooperate during the installation so that they lock the cover part 2 in the axial direction into position. Thus, the cover part 2 may, however, be removed freely in the radial direction also away from its place till the cylinder housing has been installed into its position, whereby the material of the object of installation prevents the removal.

The reference number 6 refers to a key of the lock, which, when opening the lock, is inserted through the cover part 2 into the lock cylinder in order to arrange the locking members (not shown) into the opening position of the lock in a way known per se.

The cylinder housing arrangement according to the invention may also include a separate protection fitting element 8, which is installed on top of the cover part 2 from behind the body part 1. For this reason the body part 1 is provided with a shoulder 1*a*, against which a counter shoulder 8*a* in the protection fitting element is pressed. Then the protection fitting element 8 at the same time locks the cover part 2 into position. The whole cylinder housing arrangement is attached to its object of installation by a locking nut 9.

FIGS. 2*a*, 2*b* and 2*c* as well as FIGS. 3*a*, 3*b* and 3*c* illustrate how the cylinder housing arrangement according to the invention is installed into two different objects of installation. FIGS. 2*a* and 3*a* show various installation apertures 10*a* made in the object of installation, FIGS. 2*b* and 3*b* show the cylinder housings mounted into the installation apertures 10*a* according to FIGS. 2*a* and 3*a*, seen from the front, i.e.

from the operating side, where the key is inserted into the lock, and FIGS. 2*c* and 3*c* show the arrangements of FIGS. 2*b* and 2*c* seen from behind.

In the arrangement according to FIG. 2 the assembly is completed without a separate protection fitting element, whereby the cover part 2 is directly supported by the wall of the installation aperture 10*a* in the object, which wall prevents the removal of the cover part 2 in the radial direction. The cover part 2 is also provided with a flange 2*a* extending in the radial direction, the diameter of which flange is larger than that of the body part 1 so that it not only covers the body part 1 entirely, but is also supported by the front surface of the object of installation 10. In order to make the arrangement hold its position in the object of installation its back end is provided with a support element 10*b*, by which the fixing nut 9 is supported.

In the arrangement according to FIG. 3 a protection fitting element 8 is used for preventing the removal of the cover part 2 from its position in the radial direction. The shoulders 1*a* and 8*a* shown in FIG. 1 prevent the pulling of the protection fitting element outwards, i.e. away from its position, and the fixing nut 9 mounted behind the object of installation prevents the disengagement of the whole cylinder housing arrangement.

The shaping of the parts may be varied, if needed, so that the cylinder housing arrangement may be installed in various objects of installation having different kinds of installation apertures. Similarly, the materials and material thicknesses of the various parts may be chosen on the basis of the required durability, costs etc.

Thus, the invention is not limited to the above-described applications, but several other modifications are conceivable in the scope of the appended claims.

The invention claimed is:

1. A lock cylinder housing arrangement comprising:

a cylinder housing comprising a body part having first and second opposite ends and a longitudinal axis, the cylinder housing also comprising a separate cover part that is attached to the body part at the first end thereof, wherein mutual engagement of structural elements of the body part and the cover part locks the cover part to the body part relative to the axial direction of the body part but permits detachment of the cover part from the body part by displacing the cover part relative to the body part in a crosswise direction relative to the body part, and a lock cylinder which is enclosed by the cylinder housing and comprises a number of locking elements to be arranged by a key inserted into the lock cylinder from the first end of the body part, which locking elements in an unlocked position allow the lock cylinder to turn relative to the cylinder housing and in a locked position prevent the lock cylinder turning relative to the cylinder housing, and wherein the cover part at least partly covers the lock cylinder and prevents removal of the lock cylinder from the cylinder housing.

2. A cylinder housing arrangement according to claim 1, wherein said structural elements of the body part and the cover part have respective radial counter surfaces which cooperate with one another.

3. A cylinder housing arrangement according to claim 2, wherein the cover part is cylindrical and the counter surface of the structural element of the cover part encircles the cover part.

4. A cylinder housing arrangement according to claim 1, wherein the structural element of the cover part encircles the cover part.

5. A cylinder housing arrangement according to claim 1, wherein the body part and the cover part each have a plurality of structural elements having respective radial counter surfaces that cooperate with each other to lock the cover part positively against movement relative to the body part along the longitudinal axis.

6. A cylinder housing arrangement according to claim 1, wherein the cover part comprises a flange which is radially wider than the body part and entirely covers the first end of the body part.

7. A cylinder housing arrangement according to claim 1, further comprising a separate protective fitting element, which is mounted to the cylinder housing at the first end of the body part.

8. A cylinder housing arrangement according to claim 7, wherein the body part is provided with a shoulder, which cooperates with a counter surface of the protective fitting element to determine the position of the protective fitting element in the axial direction of the body part.

9. A cylinder housing arrangement according to claim 1, wherein the body part is substantially cylindrical.

10. A cylinder housing arrangement according to claim 1, further comprising a separate protective fitting element, which is mounted to the cylinder housing at the first end of the body part and surrounds the cover part and prevents displacement of the cover part relative to the body part in said crosswise direction.

* * * * *